US005466267A

United States Patent [19]

Baillargeon et al.

[11] Patent Number: 5,466,267

[45] **Date of Patent: * Nov. 14, 1995**

[54] OLIGOMERIC/POLYMERIC MULTIFUNCTIONAL ADDITIVES TO IMPROVE THE LOW-TEMPERATURE PROPERTIES OF DISTILLATE FUELS

[75] Inventors: David J. Baillargeon, Cherry Hill; Angeline B. Cardis, Florence; Dale B. Heck, West Deptford, all of N.J.; Susan W. Johnson, Centreville, Va.

[73] Assignee: Mobil Oil Corporation, Fairfax, Va.

[ * ] Notice: The portion of the term of this patent subsequent to Dec. 21, 2010, has been disclaimed.

[21] Appl. No.: 946,223

[22] Filed: Sep. 17, 1992

[51] Int. Cl.[6] ..... C10L 1/18

[52] U.S. Cl. ..... 44/386; 44/391; 44/392; 44/393

[58] Field of Search ..... 44/386, 393

[56] References Cited

U.S. PATENT DOCUMENTS

| | | | |
|---|---|---|---|
| 3,095,402 | 6/1963 | Goldschmidt et al. | 260/45.5 |
| 4,491,455 | 1/1985 | Ishizaki et al. | 44/62 |
| 4,509,954 | 4/1985 | Ishizaki et al. | 44/62 |
| 4,900,332 | 2/1990 | Denis et al. | 44/62 |
| 5,002,588 | 3/1991 | Baillargeon et al. | 44/386 |
| 5,039,306 | 8/1991 | Baillargeon et al. | 44/391 |
| 5,112,937 | 5/1992 | Garapon et al. | 528/272 |

*Primary Examiner*—Ellen M. McAvoy
*Attorney, Agent, or Firm*—Alexander J. McKillop; Malcolm D. Keen; Charles A. Malone

[57] ABSTRACT

Additives which improve the low-temperature properties of distillate fuels are the oligomeric/polymeric reaction products of aromatic anhydrides and epoxides (or their corresponding acid/diol equivalents), with optional termonomers.

24 Claims, No Drawings

OLIGOMERIC/POLYMERIC MULTIFUNCTIONAL ADDITIVES TO IMPROVE THE LOW-TEMPERATURE PROPERTIES OF DISTILLATE FUELS

CROSS-REFERENCE TO RELATED APPLICATIONS

This application is related to pending application Ser. No. 07/620,799, Mobil docket number 5772, filed Dec. 3, 1990, now U.S. Pat. No. 5,129,917.

BACKGROUND OF THE INVENTION

1. Field of the Invention

This application is directed to oligomeric/polymeric multifunctional additives comprised of oligomers and polymer prepared from various combinations of aromatic anhydrides and long chain epoxides, mixtures thereof and post reaction products thereof having improved low-temperature properties when incorporated into distillate fuels and to fuel compositions containing same.

2. Description of Related Art

Traditionally, the low-temperature properties of distillate fuels have been improved by the addition of kerosene, sometimes in very large amounts (5–70 wt %). The kerosene dilutes the wax in the fuel, i.e., lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity; however, most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. No art is known to applicants which teaches or suggests the additive products and compositions of this invention.

BRIEF SUMMARY OF THE INVENTION

Novel oligomers/polymers comprising co-oligomers/copolymers of (1) aromatic anhydrides or diacid equivalents and long-chain (at least about $C_{12}$) epoxides or diol equivalents, (2) anhydrides and 2 or more different epoxides, one of which is a long-chain epoxide, or (3) two or more different anhydrides, one of which is aromatic, and a long-chain epoxide, and (4) post reacted oligomeric/polymeric esters of the above products (1), (2) or (3) or mixture thereof reacted with suitable functional groups have been prepared and have been found to be surprisingly active wax crystal modifier additives for distillate fuels. Distillate fuel compositions containing $\leqq 0.1$ wt % of such additives demonstrate significantly improved low-temperature flow properties, i.e., lower cloud point and lower CFPP filterability temperature.

These additives are oligomeric and/or polymeric ester products which have linear hydrocarbyl pendant groups attached to the backbone of the oligomeric/polymeric structure. These esters are derived from the polymerization of a suitable combination of monomers which include (1) one or more epoxides, (2) one or more anhydrides, and optionally (3) a reactive material, e.g., isocyanate, diisocyanate, alkyl halide, diepoxide, dianhydride, etc., which may function as a chain transfer agent, chain terminator, chain propagator, or chain cross-linking agent. Alternatively, condensation reaction with removal of water or other such by-product may be employed to make the same oligomeric/polymeric esters from a monomer mixture which may include (1) one or more diols, (2) one or more diacid equivalents (anhydride, diacid, diacid chloride, etc.), and optionally (3) the same reactive materials listed above.

Additionally, the oligomeric and/or polymeric ester products, derived as described above, may be further reacted with additional reagents in a second synthetic step so as to derivatize, cap, or otherwise modify reactive end groups or other pendant groups incorporated along the backbone of the original oligomeric/polymeric ester. These additional reagents may include, for example, amines or alcohols which would serve to convert residual acids and anhydrides in the oligomeric/polymeric ester product to alternate carboxyl derivatives such as amides, imides, salts, esters, etc. Similarly, residual epoxides would be converted to amine and ether adducts. These examples serve to illustrate, but not limit, the concept of post-reacting the original oligomeric/polymeric ester product to modify its original chemical functionality.

These oligomeric/polymeric esters are structurally very different from the known categories of polymeric wax crystal modifiers. Known polymeric wax crystal modifiers are generally radical-chain reaction products of olefin monomers, with the resulting polymer having an all-carbon backbone. The materials of this invention are condensation products of epoxides (or diols) and anhydrides (or acid equivalents) to give polymeric structures where ester functions are regularly spaced along the polymer backbone.

These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The compositions of these additives are unique. Also, the additive concentrates and fuel compositions containing such additives are unique. Similarly, the processes for making these additives, additive concentrates, and fuel compositions are unique.

The primary object of this invention is to improve the low-temperature flow properties of distillate fuels. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

DESCRIPTION OF THE PREFERRED EMBODIMENTS

The additives of this invention have comb-like structures, where a critical number of linear hydrocarbyl groups are attached to the backbone of an oligomeric/polymeric polyester. These additives are reaction products obtained by combining two, or optionally more, monomers in differing ratios using standard techniques for condensation polymerization. These wax crystal modifiers which are effective in lowering cloud point are generally characterized as alternating co-oligomers/copolymers (or optionally terpolymers, etc.) of the following type:

(-A-B)n;

(-A-A'-B) n;

(-A-B-B') n;

(-A-A'-B-B')n; or (-A-B-C-)n where n is equal to or greater than 1, A or A' is one or more aromatic anhydrides or diacid equivalents, one of which is aromatic, B or B' is one or more epoxides or diol equivalents, one of which is long chain, and C is said reactive material.

One combination of monomers may include (A) one or more anhydrides, (B) one or more epoxides, and optionally (C) a reactive material, e.g., isocyanate, diisocyanate, alkyl halide, diepoxide, dianhydride, etc., which may function as a chain transfer agent, chain terminator, chain propagator, or chain cross-linking agent. Alternatively, a second combination of monomers, in which the removal of a low molecular weight by-product accompanies the condensation reaction, may include (A) one or more diacid equivalents (anhydride, diacid, diacid chloride, etc.), (B) one or more diols, and optionally (C) the same reactive materials listed above. Comonomer stoichiometry may vary widely with A:B= 1:2 to 2:1, or preferably A:B=1:1.5 to 1.5:1, or most preferably A:B=1:1.1 to 1.1:1. Optional termonomers, component C, may substitute for some fraction of A or B in the above stoichiometric ranges.

The pendant linear hydrocarbyl groups are carried by at least one, and optionally by more than one, of the monomers. These critical linear pendant hydrocarbyl groups are generally $C_{12}$ or longer. Hydrocarbyl as used throughout this specification includes but is not limited to alkyl, alkenyl, aryl, alkaryl, aralkyl and optionally cyclic or polycyclic, where R groups, e.g., R, $R_1$, $R_2$, $R_3$ or $R_4$ each have from 1 to about 300 carbon atoms.

Aromatic monomers include, but are not limited to, monocyclic, dicyclic, polycyclic, functionalized aromatic, heterocyclic, functionalized heterocyclic, etc., structures.

Additives of this invention may be grouped into categories based on distinct structural and compositional differences, described below. Preparation of selected additives are given in EXAMPLES 1–3. Additive compositions and their respective performance for cloud point and CFPP are given in TABLES 1–4.

Category A: Aromatic Anhydride Comonomer (TABLE 1)

Simple AB-type co-oligomers/copolymers which are effective wax crystal modifier additives can be prepared from aromatic anhydrides (A comonomer) and long-chain epoxides (B comonomer) using an amine catalyst. Aromatic anhydrides may be monocyclic, e.g., phthalic anhydride, Entries 1–8, 10–11, or polycyclic, e.g., naphthalic anhydride, Entry 9, and may also be additionally functionalized (alkylated, acylated, etc.). The epoxides, in this case, are linear terminal epoxides in the $C_{16}$+ range, but other terminal epoxides may also be included in suitable additive compositions. Stoichiometries of anhydride/epoxide may vary over the range of 2/1 to 1/2, e.g., 1.4/1 to 1/1.4, Entries 1–6. Thermal reactions without the use of an amine catalyst may also give additives with the desired activity in diesel fuel, e.g., Entries 7–8.

A typical synthesis is illustrated by the preparation of the phthalate co-oligomer/copolymer Entry 2 in EXAMPLE 1.

Category B: Mixed Epoxides and Anhydride (TABLE 2)

Successful additives may be ABB'-type oligomers/polymers which can be prepared from anhydrides (A monomer) and two or more different epoxides (B, B' monomers) using an amine catalyst. Of the two or more epoxides used, one must provide the necessary long-chain paraffinic pendant group required by this invention; the other epoxide(s) may have virtually any molecular structure, and may be present at 0.001 wt % or higher. For example, epoxide mixtures may include $C_{14-C28}$ linear epoxides, e.g., Entries 12–16 and 24–27, or aromatic containing epoxides, e.g., styrene oxide, Entries 17–18, or glycidyl ethers, e.g., Entries 19–23 and 28–29. Stoichiometries of anhydride/epoxides may vary over a large range, e.g., 2/1 to 1/2, as indicated above.

A typical synthesis is illustrated by the phthalate co-oligomer/copolymer prepared from a $C_{14-C20}$ epoxide mixture, Entry 13, in EXAMPLE 2.

Category C: Epoxide and Mixed Anhydrides (TABLE 3)

Successful additives may be AA'B-type oligomers/polymers which can be prepared from two or more different anhydrides (A, A' monomers) and an epoxide (B monomer) using an amine catalyst. Of the two or more anhydrides used, no structural limitations are imposed except that one be aromatic. The minor anhydride components may be present at 0.001 wt % or higher. For example, anhydride mixtures may include nitroaromatic anhydride, e.g., nitrophthalic anhydride, Entries 49–50, tricarboxylic aromatic anhydride, e.g., trimellitic anhydride, Entries 51–53 and 56–59, aromatic anhydride, e.g., phthalic anhydride, Entries 49–55, and alkylated succinic anhydride, e.g., $C_{18}$–$C_{24}$ succinic anhydride, Entries 54–59.

A typical synthesis is illustrated by the oligomers/polymers prepared from mixed aromatic anhydrides, Entry 49, in EXAMPLE 3.

Category D: Post-Reacted Oligomeric/Polymeric Esters (TABLE 4 )

As a further extension of the additives derived in categories A, B and C above, oligomers/polymers may be post-reacted with suitable reagents in order to introduce other desirable functionality. Specifically, oligomer/polymer end groups and/or other functional groups incorporated along the backbone or side-chains may be further derivatized with suitable reagents, for example, reagents such as amines. Suitable carboxyl groups in the initial ester reaction product may be further reacted with amines to give carboxyl derivatives such as amides, imides, salts, etc. Amines which may react with initial oligomeric/polymeric ester to give post-reacted products may include, for example (Table 4), a diamine (Entries 142, 143), a polyamine (Entries 144, 145), and various polyamino-alkylated succinimides (Entries 146, 147). Other primary, secondary, and tertiary amines may also be suitably used as post-reaction reagents. Molar concentration ratios of oligomeric/polymeric ester to amine or other post-reactant may vary from 1/0.001 to 1/10, preferably 1/0.01 to 1/1.

In addition, further improvements may be obtained when a mixture of (1) amine-promoted post-reacted oligomeric/polymeric ester (above), and (2) a common pour point reducing additive are used as wax crystal modifier additives. The combination of these two materials leads to a significant and beneficial synergistic interaction which then leads to unexpected improvements in the cloud point of the treated fuel. The impact of adding pour point additive, e.g., ECA 12513, to the amine-promoted post-reacted oligomer/polymer composition is illustrated in Table 5 (see Entries 142–147 with added "PP ADDITIVE"). The specific pour point additive used in these examples is ECA 12513, but other pour point additives may be suitably used.

The reactions can be carried out under widely varying conditions which are not believed to be critical. The reaction temperatures can vary from about 100° to 225° C., preferably 120° to 180° C., under ambient or autogenous pressure. However, slightly higher pressures may be used if desired. The temperatures chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof. Reactions may also be run without any solvent.

Molar ratios, less than molar ratios or more than molar ratios of the reactants can be used.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T. Typical jet fuels are defined in Military Specification MIL-F-5624B.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from less than 0.01% to about 5% of the total weight of the composition.

The following examples are illustrative only and are not intended to limit the scope of the invention.

EXAMPLE 1

Preparation of Additive Entry 2

Phthalic anhydride (30.2 g, 0.204 mol; e.g., from Aldrich Chemical Co.), 1,2-epoxyoctadecane (53.7 g, 0.20 mol; e.g., Vikolox 18 from Viking Chemical), and 4-dimethylaminopyridine (0.85 g, 0.0069 mol; e.g., DMAP from Nepera, Inc.) were combined and heated at 120° C. for 7 hours. The viscous reaction mixture was then hot filtered through a mixed bed of alumina (approximately 20%) and Celite to give 65.6 g of the final product.

EXAMPLE 2

Preparation of Additive Entry 13

Phthalic anhydride (32.6 g, 0.22 mol; e.g., from Aldrich Chemical Co.), mixed $C_{14}$–$C_{20}$ 1,2-epoxyalkanes (59.9 g, 0.22 mol; e.g., Vikolox 13–20 from Viking Chemical), and 4-dimethylaminopyridine (0.11 g, 0.0008 mol; e.g., DMAP from Nepera, Inc.) were combined and heated at 120° C. for 23 hours. The reaction mixture was then hot filtered through a mixed bed of alumina (approximately 20%) and Celite to give 77.7 g of the final product.

EXAMPLE 3

Preparation of Additive Entry 49

Phthalic anhydride (29.3 g, 0.198 mol; e.g., from Aldrich Chemical Co.), 3-nitrophthalic anhydride (4.38 g, 0.022 mol; e.g., from Aldrich Chemical Co.), 1,2-epoxyoctadecane (62.7 g, 0.22 mol; e.g., Vikolox 18 from Viking Chemical), and 4-dimethylaminopyridine (0.11 g, 0.0008 mol; e.g., DMAP from Nepera, Inc.) were combined and heated at 120°–140° C. for 14 hours. The reaction mixture was then hot filtered through a mixed bed of alumina (approximately 20%) and Celite to give 85.2 g of the final product.

PREPARATION OF ADDITIVE CONCENTRATE

A concentrate solution of 100 ml total volume was prepared by dissolving 10 g of additive in mixed xylenes solvent. Any insoluble particulates in the additive concentrate were removed by filtration before use.

TEST FUELS

Two test fuels were used for the screening of additive activity:

| FUEL A: | | |
|---|---|---|
| API Gravity | 34.1 | |
| Cloud Point (°F.) | 23.4 | |
| CFPP (°F.) | 16 | |
| Pour Point (°F.) | 0 | |
| Distillation (°F.; D 86) | IBP | 319 |
| | 10% | 414 |
| | 50% | 514 |
| | 90% | 628 |
| | FBP | 689 |

-continued

| FUEL B: | | |
|---|---|---|
| API Gravity | 31.5 | |
| Cloud Point (°F.) | 21.4 | |
| CFPP (°F.) | 14 | |
| Pour Point (°F.) | 10 | |
| Distillation (°F.; D 86) | IBP | 340 |
| | 10% | 439 |
| | 50% | 534 |
| | 90% | 640 |
| | FBP | 693 |

TEST PROCEDURES

The cloud point of the additized distillate fuel was determined using an automatic cloud point test based on the commercially available Herzog cloud point tester; test cooling rate is approximately 1° C./minute. Results of this test protocol correlate well with ASTM D2500 methods. The test designation (below) is "HERZOG".

The low-temperature filterability was determined using the Cold Filter Plugging Point (CFPP) test. This test procedure is described in "Journal of the Institute of Petroleum", Volume 52, Number 510, June 1966, pp. 173–185.

Test results are recorded in Tables 1–10.

The products of this invention represent a significant new generation of wax crystal modifier additives which are dramatically more effective than may previously known additives. They represent a viable alternative to the use of kerosene in improving diesel fuel low-temperature performance.

TABLE 1

COMPOSITIONS AND PERFORMANCE IN DIESEL FUEL.
CATEGORY A: AROMATIC ANHYDRIDE COMONOMERS

| ENTRY | EPOXIDE or DIOL / ANHYDRIDE or ACID | MOLE RATIO | PERFORMANCE IMPROVEMENT (F): CLOUD POINT (HERZOG) | CFPP |
|---|---|---|---|---|
| | FUEL A; 1000 ppm ADDITIVE | | | |
| 1 | Vikolox 18/Phthalic Anhy | 1/1.1 | 7 | 4 |
| 2 | Vikolox 18/Phthalic Anhy | 1/1.02 | 7.2 | 6 |
| 3 | Vikolox 18/Phthalic Anhy | 1.1/1 | 8.8 | 7 |
| 4 | Vikolox 20/Phthalic Anhy | 1.1/1 | 4.1 | 0 |
| 5 | Vikolox 18/Phthalic Anhy | 1/1.4 | 6.6 | 2 |
| 6 | Vikolox 18/Phthalic Anhy | 1.4/1 | 3.1 | 6 |
| 7 | Vikolox 18/Phthalic Anhy (Thermal @ 150° C.) | 1/1 | 5.9 | 2 |
| 8 | Vikolox 18/Phthalic Anhy (Thermal @ 210° C.) | 1/1 | 7.2 | 4 |
| 9 | Vikolox 18/1,8-Naphthalic Anhy | 1.1/1 | 7.7 | 7 |
| 10 | Vikinol 18/Phthalic Anhy | 1/1 | 5.8 | 2 |
| | FUEL B; 1000 ppm ADDITIVE | | | |
| 11 | Vikolox 18/Phthalic Anhy | 1/1 | 5.4 | |

TABLE 2

COMPOSITIONS AND PERFORMANCE IN DIESEL FUEL.
CATEGORY B: MIXED EPOXIDES AND ANHYDRIDE COMONOMERS

| ENTRY | EPOXIDE or DIOL / ANHYDRIDE or ACID | MOLE RATIO | PERFORMANCE IMPROVEMENT (F): CLOUD POINT (HERZOG) | CFPP |
|---|---|---|---|---|
| | FUEL A; 1000 ppm ADDITIVE | | | |
| 12 | Vikolox 14-20/Phthalic Anhy | 1/1.1 | 4.2 | 13 |
| 13 | Vikolox 14-20/Phthalic Anhy | 1/1 | 3.8 | 20 |
| 14 | Vikolox 20-24/Phthalic Anhy | 1.1/1 | 4.3 | –2 |
| 15 | Vikolox 18/Vikolox 20-24/Phthalic Anhy | 0.75/0.25/1 | 8.5 | 7 |
| 16 | Vikolox 18/Vikolox 24-28/Phthalic Anhy | 0.75/0.25/1 | 8.2 | 11 |
| 17 | Vikolox 18/Styrene Oxide/Phthalic Anhy | 0.9/0.1/1 | 6.4 | 4 |
| 18 | Vikolox 18/Styrene Oxide/Phthalic Anhy | 0.75/0.25/1 | 4.7 | 2 |
| 19 | Vikolox 18/Araldite DY 027/Phthalic Anhy | 0.9/0.1/1 | 5.2 | 2 |
| 21 | Vikolox 18/Araldite DY 027/Phthalic Anhy | 0.75/0.25/1 | 4.9 | 0 |
| 22 | Vikolox 18/Araldite DY 023/Phthalic Anhy | 0.9/0.1/1 | 7.2 | 4 |
| 23 | Vikolox 18/Araldite DY 023/Phthalic Anhy | 0.75/0.25/1 | 5.4 | 0 |
| | FUEL B; 1000 ppm ADDITIVE | | | |
| 24 | Vikolox 14-20/Vikolox 20-24/Phthalic Anhy | 0.75/0.25/1 | 6.6 | — |
| 25 | Vikolox 14-20/Vikolox 20-24/Phthalic Anhy | 0.5/0.5/1 | 6.1 | — |
| 26 | Vikolox 18/Vikolox 14-20/Phthalic Anhy | 0.75/0.25/1 | 6.3 | — |
| 27 | Vikolox 18/Vikolox 14-20/Phthalic Anhy | 0.5/0.5/1 | 5.9 | — |
| 28 | Vikolox 18/Araldite RD-1/Phthalic Anhy | 0.9/0.1/1 | 6.1 | — |
| 29 | Vikolox 18/Araldite RD-1/Phthalic Anhy | 0.75/0.25/1 | 4.7 | — |

TABLE 3

CATEGORY C: MIXED ANHYDRIDES. COMPOSITIONS AND PERFORMANCE IN DIESEL FUEL

| ENTRY | EPOXIDE / ANHYDRIDE | MOLE RATIO | PERFORMANCE IMPROVEMENT (F): CLOUD POINT (HERZOG) | CFPP |
|---|---|---|---|---|
| | FUEL A; 1000 ppm ADDITIVE | | | |
| 49 | Vikolox 18/Nitrophthalic Anhy/Phthalic Anhy | 1/0.1/0.9 | 6.8 | 2 |
| 50 | Vikolox 18/Nitrophthalic Anhy/Phthalic Anhy | 1/0.25/0.75 | 6.5 | 2 |
| | FUEL B; 1000 ppm ADDITIVE | | | |
| 51 | Vikolox 18/Trimellitic Anhy/Phthalic Anhy | 1/0.025/1 | 5.8 | — |
| 52 | Vikolox 18/Trimellitic Anhy/Phthalic Anhy | 1/0.1/0.9 | 5.1 | — |
| 53 | Vikolox 18/Trimellitic Anhy/Phthalic Anhy | 1/0.2/0.8 | 4.1 | 5 |
| 54 | Vikolox 18/$C_{18}$–$C_{24}$ Succinic Anhy/Phthalic Anhy | 1/0.25/0.75 | 4.1 | 4 |
| 55 | Vikolox 18/$C_{18}$–$C_{24}$ Succinic Anhy/Phthalic Anhy | 1/0.95/0.05 | 4.5 | 5 |
| 56 | Vikolox 18/Trimellitic Anhy/$C_{18}$–$C_{24}$ Succinic Anhy | 1/0.025/1 | 4 | 4 |
| 57 | Vikolox 18/Trimellitic Anhy/$C_{18}$–$C_{24}$ Succinic Anhy | 1/0.1/0.9 | 3.8 | 4 |
| | FUEL B; 500 ppm ADDITIVE | | | |
| 58 | Vikolox 18/Trimellitic Anhy/$C_{18}$–$C_{24}$ Succinic Anhy | 1/0.025/1 | 3.4 | 2 |
| 59 | Vikolox 18/Trimellitic Anhy/$C_{18}$–$C_{24}$ Succinic Anhy | 1/0.1/0.9 | 3.2 | 2 |

TABLE 4

CATEGORY D: POST-REACTED OLIGOMERIC/POLYMERIC ESTERS

| ENTRY | EPOXIDE/ANHYDRIDE/POST REACTANT | MOLE RATIO | PERFORMANCE IMPROVEMENT (F): CLOUD POINT (HERZOG) | CFPP |
|---|---|---|---|---|
| | FUEL B; 500 ppm ADDITIVE | | | |
| 142 | Vikolox 18/Phthalic Anhy/Duomeen T | 1/1/0.03 | 3.7 | 4 |
| 143 | Vikolox 18/Phthalic Anhy/Duomeen T | 1/1/0.1 | 4.1 | 5 |
| 144 | Vikolox 18/Phthalic Anhy/Diethylene Triamine | 1/1/0.03 | 4.1 | 4 |
| 145 | Vikolox 18/Phthalic Anhy/Diethylene Triamine | 1/1/0.1 | 3.7 | 5 |
| 146 | Vikolox 18/Phthalic Anhy/Polyamino-polyisobutyl-alkylated succinimide | 1/1/0.03 | 2.8 | 4 |
| 147 | Vikolox 18/Phthalic Anhy/Polyamino-polyisobutyl-alkylated succinimide | 1/1/0.1 | 2.1 | 2 |

CATEGORY D: POST-REACTED OLIGOMERIC/POLYMERIC ESTER & POUR-POINT ADDITIVE MIXTURES

| ENTRY | EPOXIDE/ANHYDRIDE/ POST REACTANT ("PP" ADDITIVE) | MOLE RATIO | PERFORMANCE IMPROVEMENT (F): CLOUD POINT (HERZOG) | CFPP |
|---|---|---|---|---|
| | FUEL B; 500 ppm ADDITIVE; 200 ppm ECA 12513 | | | |
| 142 | Vikolox 18/Phthalic Anhy/Duomeen T | 1/1/0.03 | 4.3 | 4 |
| 143 | Vikolox 18/Phthalic Anhy/Duomeen T | 1/1/0.1 | 4.1 | 2 |
| 144 | Vikolox 18/Phthalic Anhy/Diethylene Triamine | 1/1/0.03 | 4.5 | 4 |
| 145 | Vikolox 18/Phthalic Anhy/Diethylene Triamine | 1/1/0.1 | 4.3 | 4 |
| 146 | Vikolox 18/Phthalic Anhy/Polyamino-polyisobutyl-alkylated succinimide | 1/1/0.03 | 3.6 | 4 |
| 147 | Vikolox 18/Phthalic Anhy/Polyamino-polyisobutyl-alkylated succinimide | 1/1/0.1 | 2.5 | 0 |

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. A multifunctional low-temperature-modifying distillate fuel additive consisting of a polymeric and/or oligomeric ester additive product of reaction prepared by polymerizing or oligomerizing a suitable combination of monomers selected from a member of the group consisting of: (1) at least one $C_{12}$ long-chain epoxide or a diol having at least 12 carbon atoms that is capable of producing a related condensation product of reaction and; (2) at least one aromatic anhydride or a diacid capable of reacting with said epoxide or diol, or mixtures of (1) and (2); or (3) a suitable material reactive with (1) and (2) or mixtures thereof selected from the group consisting of isocyanates, diisocyanates, epoxy halides, carbamates, diepoxides, dianhydrides or polyols, in varying molar ratios under suitable conditions of time, temperature and pressure which material functions as a chain modifier or cross-linking agent and wherein the molar ratios of reactants vary from equimolar to more than molar to less than molar, at temperatures varying from about 50° to about 250° C. and with pressures varying from ambient to autogenous for times varying from about an hour to about 48 hours thereby producing the desired ester additive product said product containing polymeric structures having ester functions and R, $R_1$, $R_2$, $R_3$ or $R_4$ hydrocarbyl groups each having 1 to 300 carbon atoms independently and regularly spaced along the polymer/oligomer backbone and wherein said ester additive product is (4) optionally post reacted with suitable amines, alcohols or a mixture of such amines and alcohols to provide additional functionality to said additive product.

2. The ester additive product of claim 1 wherein said additive product comprises alternating co-oligomers/copolymers or optionally terpolymers.

3. The ester additive product of reaction of claim 1 wherein said additive is prepared from monomers selected from the group consisting of (1) aromatic anhydride and epoxide comonomers, (2) mixed epoxides and anhydride comonomers, (3) mixed anhydrides and epoxide comonomers and/or is (4) a post reacted oligomeric/polymeric ester.

4. The ester additive product of reaction of claim 3 wherein the additive products of reaction described therein as prepared from (1) aromatic anhydride and epoxide comonomers selected from phthalic anhydride, 1,8-naphthalic anhydride, 1,2-epoxyoctadecane and 1,2-epoxyeicosane, (2) mixed epoxide and anhydride comonomers selected from 1,2-epoxyalkane(C 14 to C20), 1,2-epoxyalkane(C20 to C24), and mixtures of 1,2-epoxyalkanes (C14–C20) and (C20–C24), mixtures of 1,2-epoxyoctadecane and 1,2-epoxyalkane(C14 to C20 or C20 to C24 or C24 to C28), mixtures of 1,2-epoxyoctadecane and styrene oxide or 1-butanol glycidyl ether or cresol glycidyl ether or mixed C8–C10 glycidyl ether and phthalic anhydride (3) mixed anhydrides and epoxides comonomers selected from 1,2-epoxyoctadecane mixed with (a) nitrophthalic and phthalic anhydrides (b) trimellitic and phthalic anhydrides and (c) C18–C24 succinic and phthalic anhydrides and (d) trimellitic and C18–C24 succinic anhydrides or (4) as post reacted oligomeric or polymeric esters selected from 1,2-epoxyoctadecane and (a) phthalic anhydride and N-tallow-1,3-diaminopropane, (b) phthalic anhydride and diethylene triamine, (c) phthalic anhydride and polyamine-polyisobutylalkylated succinimide.

5. The additive product of claim 1 wherein at least one of said monomers and optionally more than one, has a pendant hydrocarbyl group of at least $C_{12}$.

6. The additive product of claim 1 wherein the monomers are phthalic anhydride and 1,2-epoxyoctadecane.

7. The additive product of claim 1 wherein the monomers are phthalic anhydride and a mixture of $C_{14}$–$C_{20}$ 1,2-epoxyalkanes.

8. The additive product of claim 1 wherein the monomers are phthalic anhydride, 3-nitrophthalic anhydride and 1, 2-epoxyoctadecane.

9. A process of preparing a multifunctional low-temperature modifying distillate fuel polymeric and/or oligomeric ester product of reaction comprising polymerizing or oligomerizing a suitable combination of monomers selected from the group consisting of (1) one or more epoxides or diol equivalents (2) one or more aromatic anhydrides or diacid equivalents or mixtures of (1) and (2), and (3 optionally a suitable reactive material selected from the group consisting of isocyanates, diisocyanates, epoxy halides, carbamates, diepoxides, dianhydrides or polyols, in varying molar ratios under suitable conditions of time, temperature and pressure and wherein the molar ratios of reactants varies from equimolar to more than molar to less than molar, at temperatures varying from about 50° to about 250° C. and with pressures varying from atmospheric to slightly higher for times varying from about an hour to 48 hours or more thereby producing the desired ester additive product said product containing polymeric structures having ester functions having long-chain hydrocarbyl groups independently and regularly spaced along the polymer backbone and wherein hydrocarbyl is selected from the group consisting of alkyl, alkenyl, aryl, aralkyl, alkaryl, which may be cyclic or polycyclic and wherein said ester additive product of reaction is (4) optionally post reacted with a suitable reagent selected from suitable amines and alcohols or mixtures of such amines and alcohols.

10. The process of claim 9 wherein at least one of said monomers and optionally more than one, has a pendant hydrocarbyl group of at least $C_{12}$.

11. The process of claim 9 wherein the monomers are phthalic anhydride and 1,2-epoxyoctadecane.

12. The process of claim 9 wherein the monomers are phthalic anhydride and a mixture of $C_{14}$–$C_{20}$ 1,2-epoxyalkanes.

13. The process of claim 9 wherein the monomers are phthalic anhydride, 3-nitrophthalic anhydride and 1, 2-epoxyoctadecane.

14. A fuel additive concentrate comprising a suitable major amount of a liquid hydrocarbon solvent having dissolved therein a minor effective amount of a low-temperature modifying fuel additive product of reaction as claimed in claim 1.

15. The fuel additive concentrate of claim 14 having a total volume of about 100 ml, and having about 10 g of said additive product of reaction dissolved therein.

16. The fuel additive concentrate of claim 14 wherein said solvent is selected from the group consisting of xylene, mixed xylenes and toluene.

17. A liquid hydrocarbyl fuel composition comprising a major amount of said fuel and a minor amount of a multifunctional low-temperature modifying distillate fuel polymeric and/or oligomeric ester additive product of reaction prepared by polymerizing or oligomerizing a suitable combination of monomers selected from a member of the group consisting of: (1) at least one $C_{12}$ epoxide or at least one $C_{12}$ diol that is capable of producing a related condensation product of reaction and; (2) at least one anhydride or a diacid capable of reacting with said epoxide or diol, or mixtures of (1) and (2); and (3) a suitable material reactive with (1) and (2) selected from the group consisting of isocyanates, disocyanates, epoxy halides, carbamates, diepoxides, dianhydrides or polyols, in varying molar ratios under suitable conditions of time, temperature and pressure which material functions as a chain modifier or cross-linking agent and wherein the molar ratios of reactants vary from equimolar to more than molar to less than molar, at temperatures varying from about 50° to about 250° C. and with pressures varying from ambient to autogenous for times varying from about an hour to about 48 hours thereby producing the desired ester additive product said product containing polymeric structures having ester functions and long-chain R, $R_1$, $R_2$, $R_3$ or $R_4$ hydrocarbyl groups each having 1 to 300 carbon atoms independently and regularly spaced along the polymer/oligomer backbone and wherein said ester additive product of reaction is (4) post reacted with a suitable reagent selected from suitable amines and alcohols or a mixture of such amines and alcohols to provide additional functionality to said additive product.

18. The fuel composition of claim 16 wherein the additive product of reaction is prepared from monomers selected from the group consisting of (1) aromatic anhydrides and epoxides as comonomers, (2) mixed epoxides and anhydrides as comonomers, (3) mixed anhydrides and epoxides as comonomers or are (4) post reacted oligomeric or polymeric esters.

19. The fuel composition of claim 17 wherein the additive product of reaction described therein is prepared from (1) aromatic anhydride and epoxide comonomers selected from phthalic anhydride, 1,8-naphthalic anhydride, 1,2-epoxyoctadecane and 1,2-epoxyeicosane, (2) mixed epoxide and anhydride comonomers selected from 1,2-epoxyalkane ($C_{14}$ to $C_{12}$), 1,2-epoxyalkane ($C_{20}$ to $C_{24}$), and mixtures of 1,2-epoxyalkanes ($C_{14}$–$C_{20}$) and ($C_{12}$–$C_{24}$), mixtures of 1,2-epoxyoctadecane and 1,2-epoxyalkane ($C_{14}$ to $C_{20}$), or $C_{20}$ to $C_{24}$) or $C_{24}$ to $C_{28}$), mixtures of 1,2-epoxyoctadecane and styrene oxide or 1 butanol glycidyl ether or cresol glycidyl ether or mixed $C_8$–$C_{10}$ glycidyl ether and phthalic anhydride, (3) mixed anhydrides and epoxides comonomers selected from 1,2-epoxyoctadecane mixed with (a) nitrophthalic and phthalic anhydrides (b) trimellitic and phthalic anhydrides and (c) $C_{18}$–$C_{24}$ succinic and phthalic anhydrides and (d) trimellitic and $C_{18}$–$C_{24}$ succinic anhydrides or (4) post reacted oligomeric or polymeric esters selected from 1,2epoxyoctadecane and (a) phthalic anhydride and N-tallow-1,3-diaminopropane, (b) phthalic anhydride and diethylene triamine, (c) phthalic anhydride and polyamine-polyisobutyl-alkylated succinimide.

20. The fuel additive concentrate of claim 15 wherein at least one of said monomers and optionally more than one, has a pendant hydrocarbyl group of at least $C_{12}$.

21. The fuel additive concentrate of claim 15 wherein the monomers are phthalic anhydride and 1,2-epoxyoctadecane.

22. The fuel additive concentrate of claim 15 wherein the monomers are phthalic anhydride and a mixture of $C_{14}$–$C_{20}$ 1,2-epoxyalkanes.

23. The fuel additive concentrate of claim 15 wherein the monomers are phthalic anhydride, 3-nitrophthalic anhydride and 1, 2- epoxyoctadecane.

24. The fuel composition of claim 17 comprising from about 0.001 to about 10% by weight based on the total weight of the composition of the additive product of reaction.

* * * * *